US008635723B2

(12) United States Patent
Zubeldia Jauregui

(10) Patent No.: US 8,635,723 B2
(45) Date of Patent: Jan. 28, 2014

(54) MECHANISED BED FOR AUTOMATICALLY STRAIGHTENING BEDCLOTHES

(76) Inventor: Ascensio Zubeldia Jauregui, Villabona (ES)

( * ) Notice: Subject to any disclaimer, the term of this patent is extended or adjusted under 35 U.S.C. 154(b) by 213 days.

(21) Appl. No.: 13/124,560

(22) PCT Filed: Feb. 11, 2009

(86) PCT No.: PCT/ES2009/000078
§ 371 (c)(1),
(2), (4) Date: Apr. 15, 2011

(87) PCT Pub. No.: WO2010/052347
PCT Pub. Date: May 14, 2010

(65) Prior Publication Data
US 2011/0197360 A1 Aug. 18, 2011

(30) Foreign Application Priority Data
Nov. 6, 2008 (ES) ..... 200803177

(51) Int. Cl.
*A47C 21/00* (2006.01)

(52) U.S. Cl.
USPC ..... 5/488; 5/692

(58) Field of Classification Search
USPC ..... 5/488, 658, 482, 510–511, 692
See application file for complete search history.

(56) References Cited

U.S. PATENT DOCUMENTS

| | | | | |
|---|---|---|---|---|
| 4,305,167 | A * | 12/1981 | Bargados | 5/488 |
| 4,441,222 | A * | 4/1984 | Tascarella | 5/488 |
| 8,250,688 | B2 * | 8/2012 | Alegria Mendez et al. | 5/658 |
| 2011/0308018 | A1 * | 12/2011 | Alegria Mendez et al. | 5/658 |

* cited by examiner

*Primary Examiner* — Fredrick Conley
(74) *Attorney, Agent, or Firm* — Jesus Sanchelima; Christian J. Sanchelima

(57) ABSTRACT

The present invention relates to a mechanized bed for automatically straightening bedclothes comprising a frame (1) which on each side incorporates a trapezoidal track (2) along which there is driven a moveable carriage which on its route activates the tensor rod (7) and the pressure roller (10) such that they straighten the top bedcover (12) longitudinally and transversally from the feet to the head depositing it on the bottom sheet (13) which is provided with elastic and Velcro-type openable sticking means to attach it to the mattress cover (11*a*) and at the head of the bed for each of the pillows (20) there is a frame (22) containing a mobile unit (22*b*) that can move up and down in which there rotates a tray stretching and straightening the cover or the pillow itself and subsequently depositing it on the top bedcover (12).

4 Claims, 8 Drawing Sheets

MECHANISED BED FOR AUTOMATICALLY STRAIGHTENING BEDCLOTHES

BACKGROUND OF THE INVENTION

1. Field of the Invention

This invention relates to a bed which is provided with mechanized means which enable automatically straightening bedclothes, i.e., it "makes the bed".

2. Description of the Related Art

Making the bed after waking up is a daily chore which, though it seems minor, is a time-consuming ritual. Many people are unable to leave home without making the bed, which can often be the source of permanent arguments or discussions between parents and children.

It is a known fact that for many people, it is annoying, even laborious, to make a bed after getting up; sometimes this is because of mere comfort, other times because one is in a hurry and has no time. For others with handicaps, it may be a more difficult task.

There are also a fair number of cases, the painful cases, in which due to the user's age, genetic malformations or having suffered an accident, the user may have some type of disability that prevents him/her from being able to make his/her bed, or in order to do so, he/she must exert an extraordinary effort that may even be hazardous to his/her physical condition.

SUMMARY OF THE INVENTION

The invention herein proposed presents a mechanized bed which is made automatically by means of straightening the bedclothes once the user has stopped occupying the bed; for this purpose, the bed according to the invention comprises a frame housing a bed support supported on a base with legs and which on each side incorporates a trapezoidal track along which there is driven a moveable carriage which is provided with a fixed wheel and a mobile wheel. The fixed wheel moves horizontally along the lower face of the lower side of the trapezoidal track. The mobile wheel moves along the outer faces of the upward, upper, downward and lower sides of said trapezoidal track, while at the same time this mobile wheel is installed on a vertical spring and attached to a tensor rod, which is susceptible to moving vertically between a lower compressed or retracted vertical spring position with respect to the upper plane of the mattress, and an upper extended or projecting vertical spring position with respect to the upper face of the mattress, in the lower position of which the tensor rod has a projection which is supported under a rotating arm, which is mounted against a circlip and which has attached thereto a pressure roller. This pressure roller is at rest in this position with its axis in the vertical position, and in which upper position of the tensor rod the rotating arm occupies a position rotated 90° in which the pressure roller is with its axis in the horizontal position and applied against the lower face of a top bedcover of the bed which is previously supported on the tip of the tensor rod and which incorporates at its longitudinal edge a cord going from the plastic guide to the front end of the top bedcover which is housed with a sliding adjustment along a horizontal craddle formed in the rotating arm. The moveable carriage is guided by a bar, which traverses it and, with respect to its movement, this carriage has two transverse faces attached to the ends of an endless line wound on the shaft of an electric geared motor.

According to the invention, the moveable carriage operates by means of an active route going from the foot to the head of the bed, a return route following the opposite path, a transitional route for the transition from the return route to the active route and a transitional route for the transition from the active route to the return route; in the active route the mobile wheel travels on the upper side of the trapezoidal track and the tensor rod is in its raised position, with its tip pressing the lower face of the top bedcover from the bottom up, while at the same time the pressure roller is in its rotated position pressing said lower face of the top bedcover in a location above the cord housed in a sliding manner in the horizontal craddle formed in the rotating arm; in the return route the mobile wheel travels on the lower side of the trapezoidal track and the tensor rod is in its lowered or inhibited position, while at the same time the pressure roller is with its axis in the horizontal position matching the rest position of the rotating arm driven by its opposing circlip; in the transitional route for the transition from the return route to the active route the mobile wheel, driven by the vertical spring, travels on the upward side of the track and drives the tensor rod to its raised position against the circlip of the rotating arm; in the transitional route for the transition from the active route to the return route the mobile wheel is guided between the downward side of the trapezoidal track and a partition parallel thereto, a rail being formed therebetween which has an outlet at its lower end traversed by a door the closing of which is driven by an opposing spring.

In this manner, in the return route both the fixed wheel and the mobile wheel run along the lower side of the trapezoidal track supported on the lower face thereof. When the end of the lower side of the trapezoidal track is reached, it acts like an end stop changing the rotational direction of the electric geared motor, while at the same time the fixed wheel remains under this lower side and the mobile wheel finds an upper empty space towards which it is driven by the vertical spring, which combined with the pulling performed by the endless line on the moveable carriage now in the reverse direction, forces this mobile wheel to run along the upward side of the trapezoidal track, whereby the tensor rod moves up until pressing on the lower face of the top bedcover and, in its path, its projection makes the rotating arm turn 90° so that the pressure roller is positioned at the level of the plastic guide which the top bedcover has on a side and ends up pressing the top bedcover in a location above its lateral longitudinal cord; then, the moveable carriage takes the active route in which the mobile wheel runs on the upper side of the trapezoidal track and, at the end thereof, it meets up with the partition forming a rail with the downward side of the trapezoidal track and travels downwards in a guided manner until reaching the door and forcing it open against its opposing spring which closes it when the mobile wheel again reaches the position in which it is arranged for traveling on the lower side of the trapezoidal track, in a new return route; in this downward path the tensor rod returns to its inhibited position while at the same time an end stop has been actuated to reverse the rotating direction in the electric geared motor.

Also attached to the trapezoidal track in the rear part (feet) there is a housing in which is inserted the plastic guide which the top bedcover has on a side in the rear part so that upon rotating the rotating arm 90°, it always positions the pressure roller above the lateral longitudinal cord and said cord is also housed in a sliding manner in the horizontal craddle formed in the rotating arm.

Another particularity of the invention consists of the fact that at the head of the bed, for each of the pillows there is a frame with a type of tray made of a round tube and its ends are attached to the mobile unit and are capable of turning the tray over therein between a vertical position placed against the rear part of the head of the bed and another horizontal position capable of holding the pillow above the level of the top bedcover when it is pressed from the bottom up by the tensor rod in the active route of the moveable carriage; the trays are linked by means of a cable mechanism and extension coil spring to the mobile unit; the tray has relaxed and tensed states which correspond with said vertical and horizontal positions of the tray; the mobile unit is guided in the frame of the head and is provided with a lower flange and with an upper hole; in the raised position of the mobile unit the lower flange drives a stop which is associated with the tray such that its non-driven and driven states correspond to respective vertical and horizontal positions of this tray; the mobile unit is fastened by a cable at each end which is pulled in its upward and downward movements by an electric geared motor as the cable is wound around or unwound from its shaft; the upper hole of the mobile unit is passed through by the tensing rope attached at one end to the covers of the pillows and the plastic of the other end of the rope attached in the housing of the part which is attached to the upper part of the frame of the head. As described in detail below with the aid of the drawings, this device will enable repositioning the pillows and stretching and straightening their covers in coordination with the straightening of the top bedcover.

According to an aspect of the invention, the top bedcover includes a sheet, a duvet cover, a blanket, a comforter or any other type used which, at the rear of its two sides. A plastic guide is mounted to the end of the lateral longitudinal cord that extends to the front end of the top bedcover of the bed. The plastic guide is inserted through a slot in the housing the trapezoidal track has on a side towards the rear. It is upon rotating the rotating arm 90° that, the pressure roller positions itself above the lateral longitudinal cord is also slidably housed in the horizontal craddle in the rotating arm. The top bedcover will be arranged on a bottom sheet provided with elastic and Velcro-type loop and hook fastening means to attach it to the mattress cover.

Another aspect of the invention includes a pillow cover attached with a rope, twine, or equivalent used to mount to attach the pillow cover end to the other plastic end, with Velcro, zipper, or equivalent used in the housing of a firm body quickly and said pillow cover is also closed on the two sides with a Velcro-type openable sticking means so that the pillow remains fixed inside the cover, this type of attaching, rope, twine, Velcro, zipper or any other type used can be placed directly on the pillow for its mobility.

Another aspect of the invention consists of the frame having a switch which, if it is placed in automatic mode when the user no longer occupies the bed, operates the electric geared motors and automatically starts making the bed, straightening and repositioning the bedclothes in an orderly fashion, and if the switch is placed in manual programmed mode, when the green button of the programming remote control is pressed or by the programming remote control emitting according to what is programmed, it operates the electric geared motors which, in combination with sensors in the legs or in the lower part of the bed support, are capable of detecting the presence of a user supported on the bed, inhibiting the operation and activating the adjustable timer means which order the automatic operation after an established time in which said presence of a supported user has not been detected.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 12 is incorporated; it also shows the bottom sheet (13) which in its four faces longitudinally has elastic fabric (13*a*) and which has in the lower part of the elastic fabric (13*a*) and longitudinally has in its four inner faces a Velcro-type openable (female) sticking means (13*b*), said FIG. 12 also shows the mattress cover (11*a*) which in its four outer faces longitudinally has a Velcro-type openable (male) sticking means (11*b*) and at one end has a zipper (11*c*) through which the mattress is inserted, the same FIG. 12 also shows the pillow cover (20*a*) in which the attachment of one end of the rope (20*b*) thereto and the other end of the rope having any part (20*c*) for housing in the housing (22*a*) are seen, said pillow cover (20*a*) also has at the two ends Velcro-type openable (male and female) sticking means (20*b*), this FIG. 12 incorporates an enlarged detail thereof.

Figures 1, 1A, 1B:
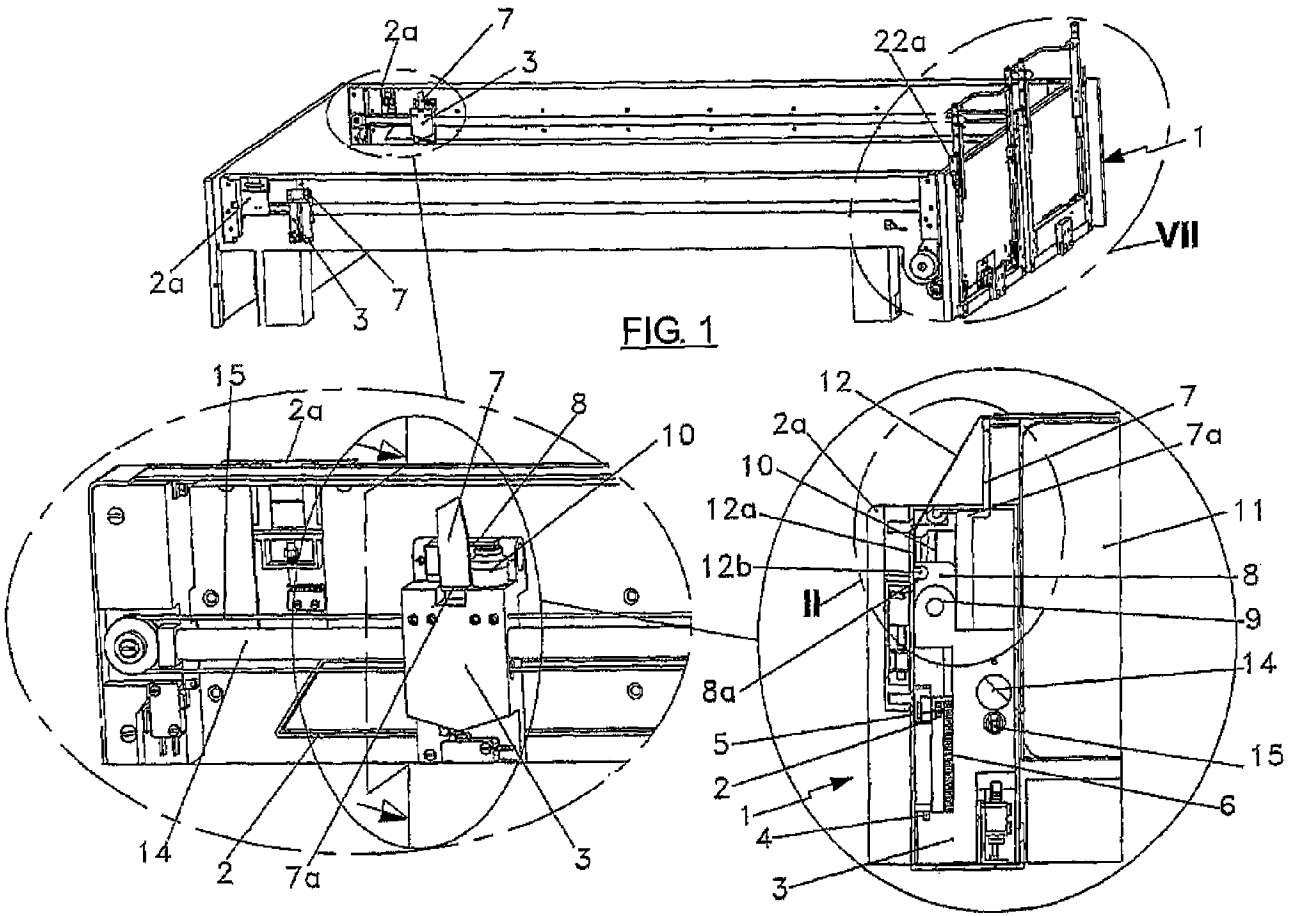
FIG. 1 is a perspective view showing the frame (1) of the mechanized bed of the invention, where the tensor rod (7) is in its lowered or inhibited position corresponding to the return route of the moveable carriage (3) and the housing (2*a*) in which the plastic guide (12*a*) of the top bedcover (12) is inserted. This FIG. 1 includes an enlarged detail of the rear part of the mechanism corresponding to the left side of the bed and from which there is in turn an enlarged elevational detail of the section indicated therein, in which section seen from the feet to the head of the bed, any position of the active route of the moveable carriage (3) is shown, i.e., with the tensor rod in its operating upper position, the frame (1), the mattress (11) the housing (2*a*), the plastic guide (12*a*) and the top bedcover (12) also having been included now in this detail.
FIG. 1A is an enlarged detail of carriage (3) mounted to bar (14).
FIG. 1B is an isometric view of carriage (3) mounted to bar (14).
Figure 1C:
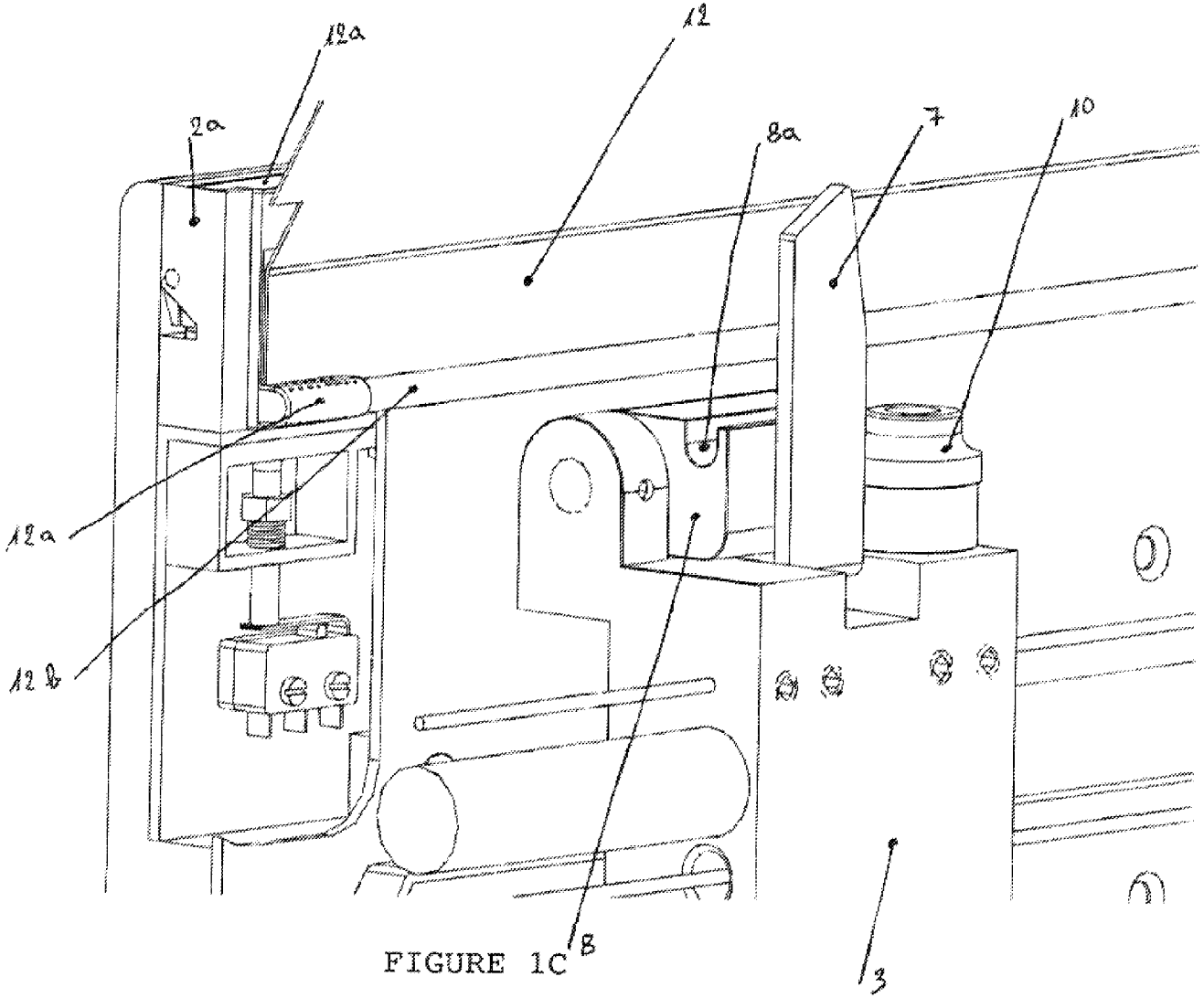
FIG. 1C is an enlarged isometric view of part of carriage (3) mounted to rod (14).
Figure 1D:
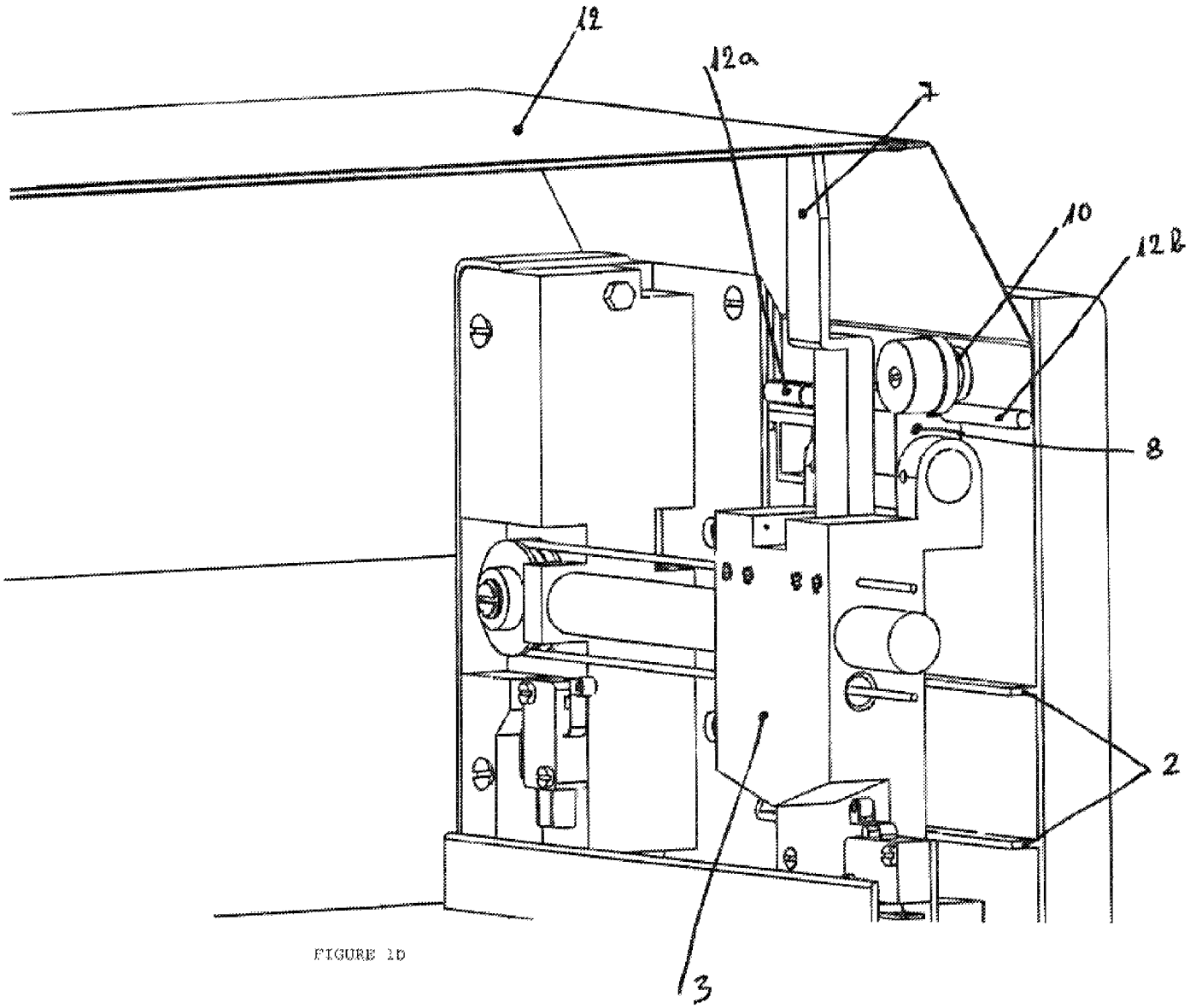
FIG. 1D is an isometric view of carriage (3) with tensor rod (7) pushing bedcover 12 upwardly.
Figure 2:
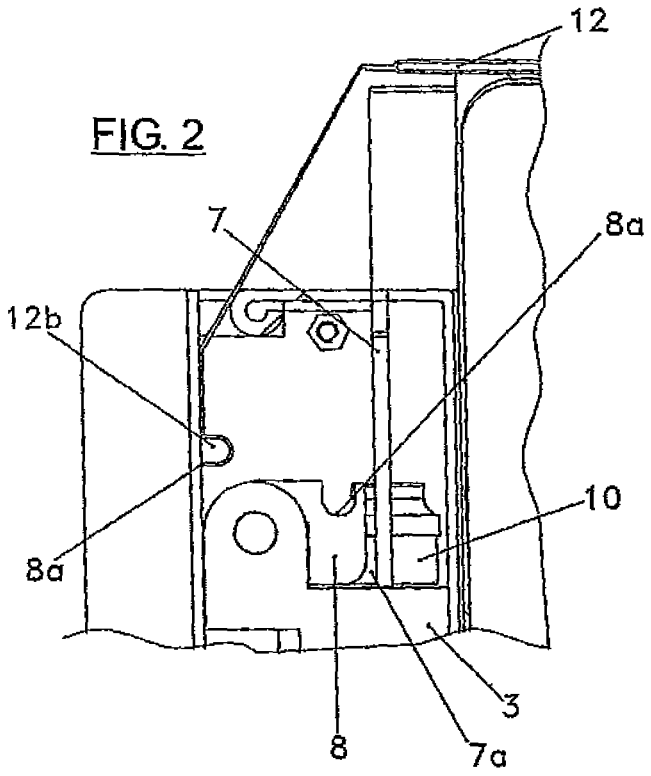
FIG. 2 is an enlarged view of detail II circled in FIG. 1, but showing the moveable carriage (3) in a position along the return route.

The following references are indicated in these figures:

1.—Frame
2.—Trapezoidal track
2*a*.—Housing of the plastic guide of the top bedcover (12)
3.—Moveable carriage
4.—Fixed wheel
5.—Mobile wheel
6.—Vertical spring
7.—Tensor rod
7*a*.—Projection of the tensor rod (7)
8.—Rotating arm
8*a*.—Horizontal craddle of the rotating arm (8)
9.—Spring
10.—Pressure roller
11.—Mattress
11*a*.—Mattress cover
11*b*.—Velcro (male)
11*c*.—Zipper
12.—Top bedcover
12*a*.—Plastic guide which the top bedcover (12) has on one side
12*b*.—Cord of the top bedcover (12)
13.—Bottom sheet
13*a*.—Elastic fabric
13*b*.—Velcro (female)
14.—Bar for guiding the moveable carriage (3)
15.—Endless line
16.—Electric geared motor
17.—Partition
18.—Door
19.—Opposing spring for the door (18)
20.—Pillow
20*a*.—Pillow cover
20*b*.—Rope
20*c*.—Plastic
20*d*.—Velcro
21.—Tray
21*a*.—Stop associated with the frame of the head (22)
21*b*.—Cable
22.—Frame of the head
22*a*.—Housing of the plastic which the rope of the pillow cover has at one end.
22*b*.—Mobile unit
22*c*—Lower flange of the mobile unit (22*b*)
22*d*.—Upper hole of the mobile unit (22*b*)
23.—Tensing rope of the pillow covers (20)
24.—Cable
25.—Extension coil spring

DETAILED DESCRIPTION OF THE EMBODIMENTS OF THE INVENTION

In relation to the aforementioned drawings and reference numbers, the attached drawings illustrate a preferred embodiment of the object of the invention relating to a mechanized bed for automatically straightening bedclothes, which, as illustrated in FIG. 1, comprises a frame (1) housing a bed support supported on a base with legs and which on each side incorporates a trapezoidal track (2) along which there is driven a moveable carriage (3) which is provided with a fixed wheel (4) and a mobile wheel (5), the fixed wheel (4) moves horizontally along the lower face of the lower side of the trapezoidal track (2), the mobile wheel (5) moves along the outer faces of the upward, upper, downward and lower sides of said trapezoidal track (2), while at the same time this mobile wheel (5) is installed on a vertical spring (6) and attached to a tensor rod (7) which is susceptible to moving vertically between a lower compressed or retracted vertical spring (6) position with respect to the upper plane of the mattress (11), and an upper extended or projecting vertical spring (6) position with respect to the upper face of the mattress (11), in the lower position of which the tensor rod (7) has a projection (7*a*) which is supported under a rotating arm (8) which is mounted against a circlip (9) and which has attached thereto a pressure roller (10) which is at rest in this position with its axis in the vertical position, and in which upper position of the tensor rod (7) the rotating arm (8) occupies a position rotated 90° in which the pressure roller (10) is with its axis in the horizontal position and applied against the plastic guide (12*a*) which is housed in the housing (2*a*), which lower face of the top bedcover (12) of the bed which is previously supported on the tip 7*b* of the tensor rod (7) and which incorporates at its longitudinal edge a cord (12*b*) going from the plastic guide (12*a*) to the front end of the top bedcover (12) which is housed with a sliding adjustment along a horizontal craddle (8*a*) formed in the rotating arm (8).

Figure 3:
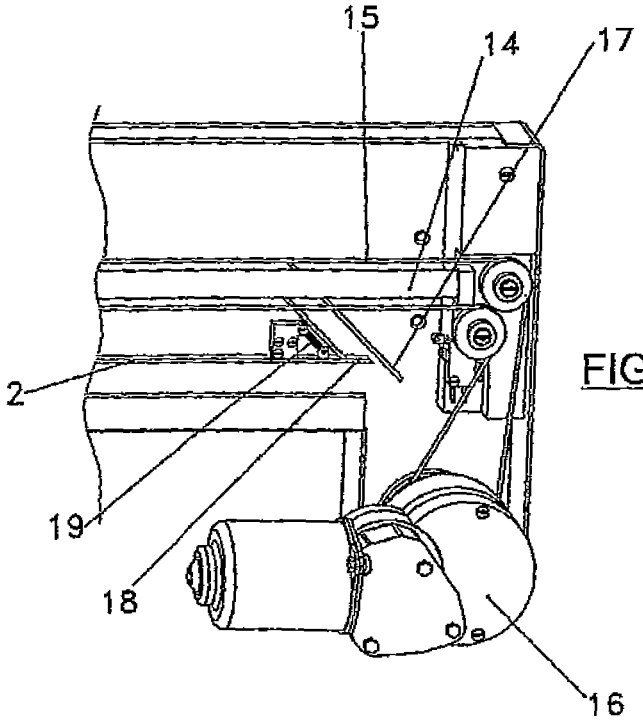
FIG. 3 is an enlarged perspective view similar to the view of the enlarged detail of FIG. 1, but in reference to an end front part of the mechanism of the left side of the bed of the invention.

As can be clearly seen in FIGS. 1 and 3, for its operating movement the moveable carriage (3) is guided by a bar (14) which traverses it and, with respect to its movement this carriage (3) has two faces attached to the ends of an endless line (15) wound on a pulley coupled to the shaft of electric geared motor (16). The moveable carriage (3) thus operates by means of an active route going from the foot to the head of the bed, a return route following the opposite path, a transitional route for the transition from the return route to the active route and a transitional route for the transition from the active route to the return route; in the active route the mobile wheel (5) travels on the upper side of the trapezoidal track (2) and the tensor rod (7) is in its raised position, with its tip pressing the lower face of the top bedcover (12) from the bottom up, while at the same time the pressure roller (10) is in its rotated position pressing said lower face of the top bedcover (12) in a location above the cord (12*b*) housed in a sliding manner in the horizontal craddle (8*a*) formed in the rotating arm (8); in the return route the mobile wheel (5) travels on the lower side of the trapezoidal track (2) and the tensor rod (7) is in its lowered or inhibited position, while at the same time the pressure roller (10) is with its axis in the horizontal position matching the rest position of the rotating arm (8) driven by its opposing circlip (9); in the transitional route for the transition from the return route to the active route the mobile wheel (5), driven by the vertical spring (6), travels on the upward side of the track and drives the tensor rod (7) to its raised position against the circlip (9) of the rotating arm (8); in the transitional route for the transition from the active route to the return route the mobile wheel (5) is guided between the downward side of the trapezoidal track (2) and a partition (17) parallel thereto (FIG. 3), a rail being formed therebetween which has an outlet at its lower end traversed by a door (18) the closing of which is driven by an opposing spring (19).

Figure 4:
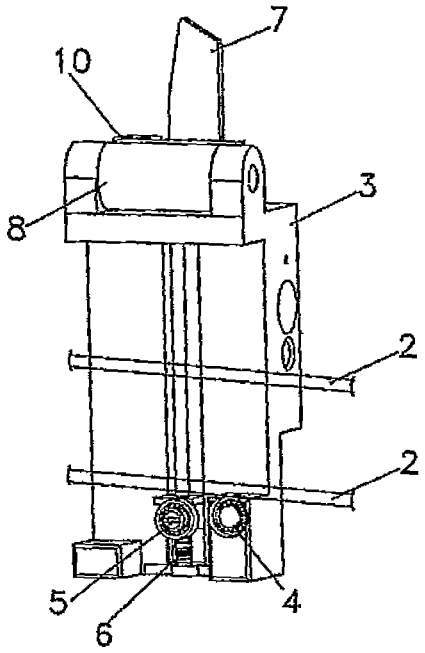
FIG. 4 shows the sub-assembly corresponding to the moveable carriage (3), in which the tensor rod (7) is in the inhibited position of the return route; respective portions of the lower and upper sides of the trapezoidal track (2) are positioned therein. The view is taken from the face of the moveable carriage (3) oriented towards this trapezoidal track (2).
Figure 5:
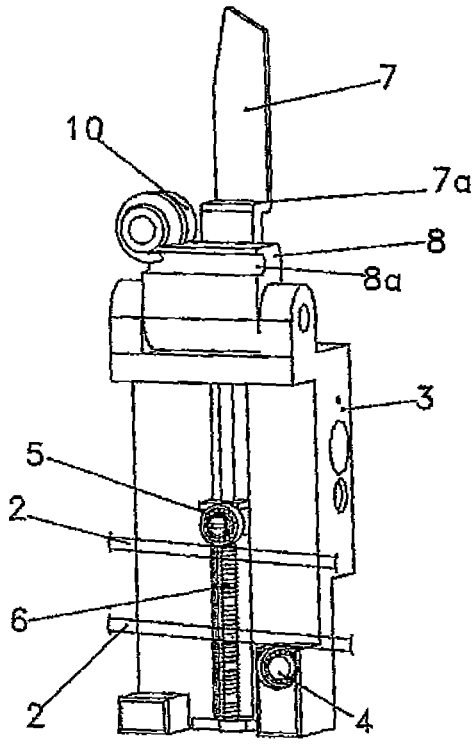
FIG. 5 is like FIG. 4, but showing the tensor rod (7) in the extended position of the active route.
Figure 6:
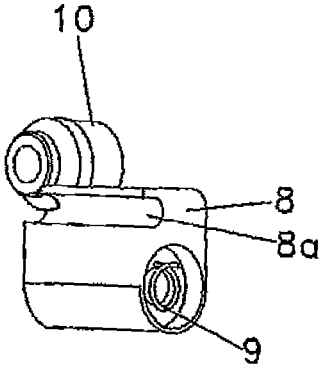
FIG. 6 is a perspective view of the rotating arm (8) in the rotated position corresponding to FIG. 5.

The result of this operation is that, no matter how out of place the bedclothes are, when the system is activated and the moveable carriage (3) reaches the end of the return route and the mobile wheel (5) starts to go up the upward side of the trapezoidal track (2) (situation which is almost reached in FIG. 1), tensor rod (7), which is integral with this mobile wheel (5), also goes up (FIGS. 4 and 5) and presses the top bedcover (12) with its tip from the bottom up, suitably raising it above the bottom sheet (13), and in this upward movement of the tensor rod (7) with its projection (7*a*) causes the rotating arm (8) to turn over against its (FIG. 6) opposing circlip (9) and makes the pressure roller (10) press on the plastic guide (12*a*), being placed on the inner face of the top bedcover (12) in a location above the beginning of the cord (12*b*) running along the craddle (8*a*) of the rotating arm (8) itself; then, when the active route is taken, the tensor rod (7) and the pressure roller (10) longitudinally and transversally straighten the top bedcover (12), with the cord (12*b*) sliding in the craddle (8*a*), until reaching the end of this route at the head of the bed, at which time the mobile wheel (5) moves down along the downward side of the trapezoidal track (2), making the tensor rod (7) and the pressure roller (10) stop their action on the top bedcover (12) and the latter is softly deposited on the bottom sheet (13) fitted on the mattress cover (11*a*); the lowering of the mobile wheel (5) is guided with the aid of the partition (17) and at the end thereof the door (18) is opened elastically against its own opposing spring (19), which immediately returns it to its closed position to prevent an unwanted return of the mobile wheel (5).

Figure 7:
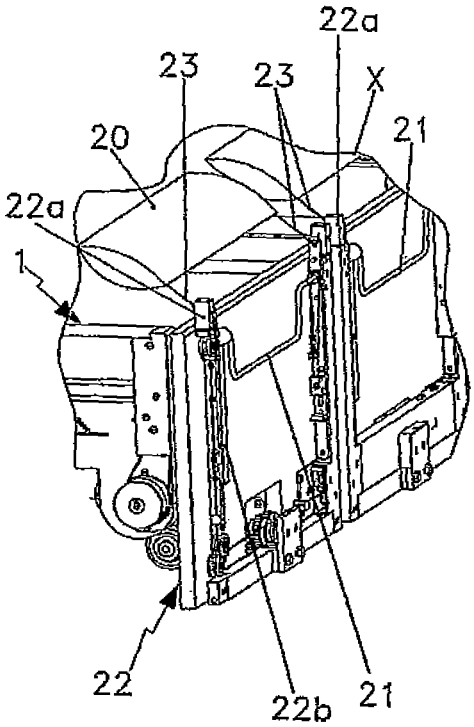
FIG. 7 is an enlarged view of detail VII circled in FIG. 1, but adding the pillows (20), which are supported on the bed, and showing the trays (21) placed against the back of the head of this bed.
Figure 8:
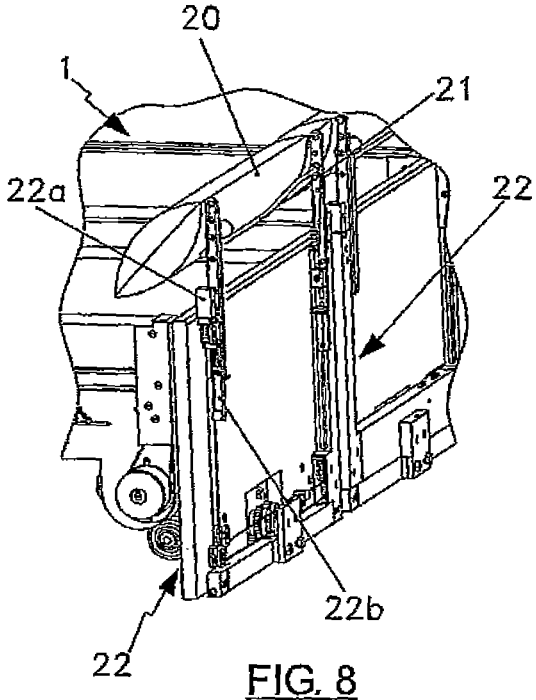
FIG. 8 is like FIG. 7, but showing an intermediate position of the maneuver of stretching and straightening the pillow cover (20*a*), in which the trays (21) are at a point of the work route between the vertical and the horizontal positions.
Figure 9:
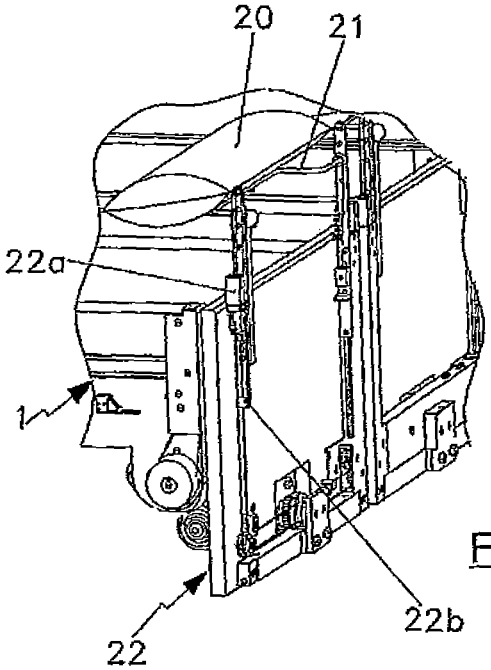
FIG. 9 is like FIG. 8, but showing the highest position of the trays (21) carrying the pillows (20).
Figure 10:
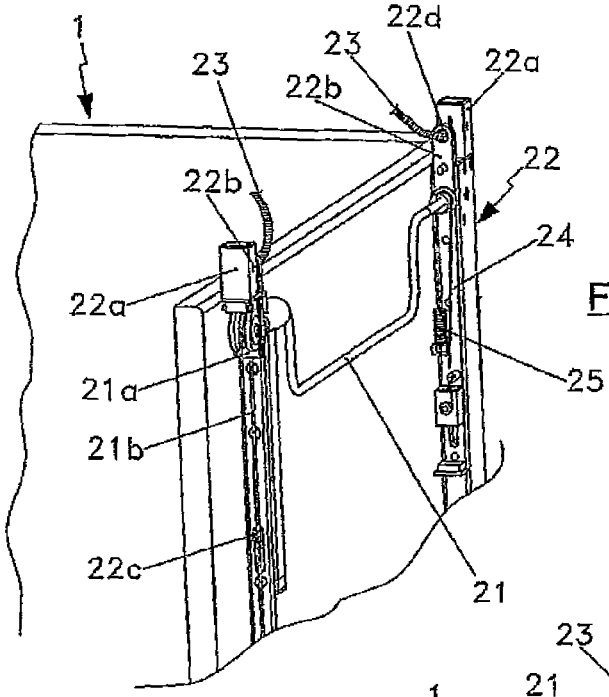
FIG. 10 is an enlarged view of detail X circled in FIG. 7.
Figure 11:
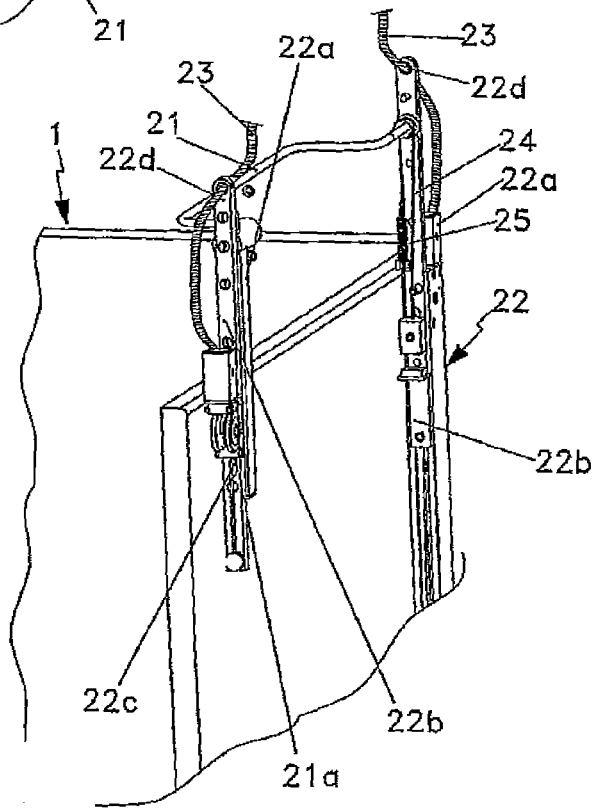
FIG. 11 is like FIG. 10, but with the tray (21) in the horizontal position.
Figure 12:
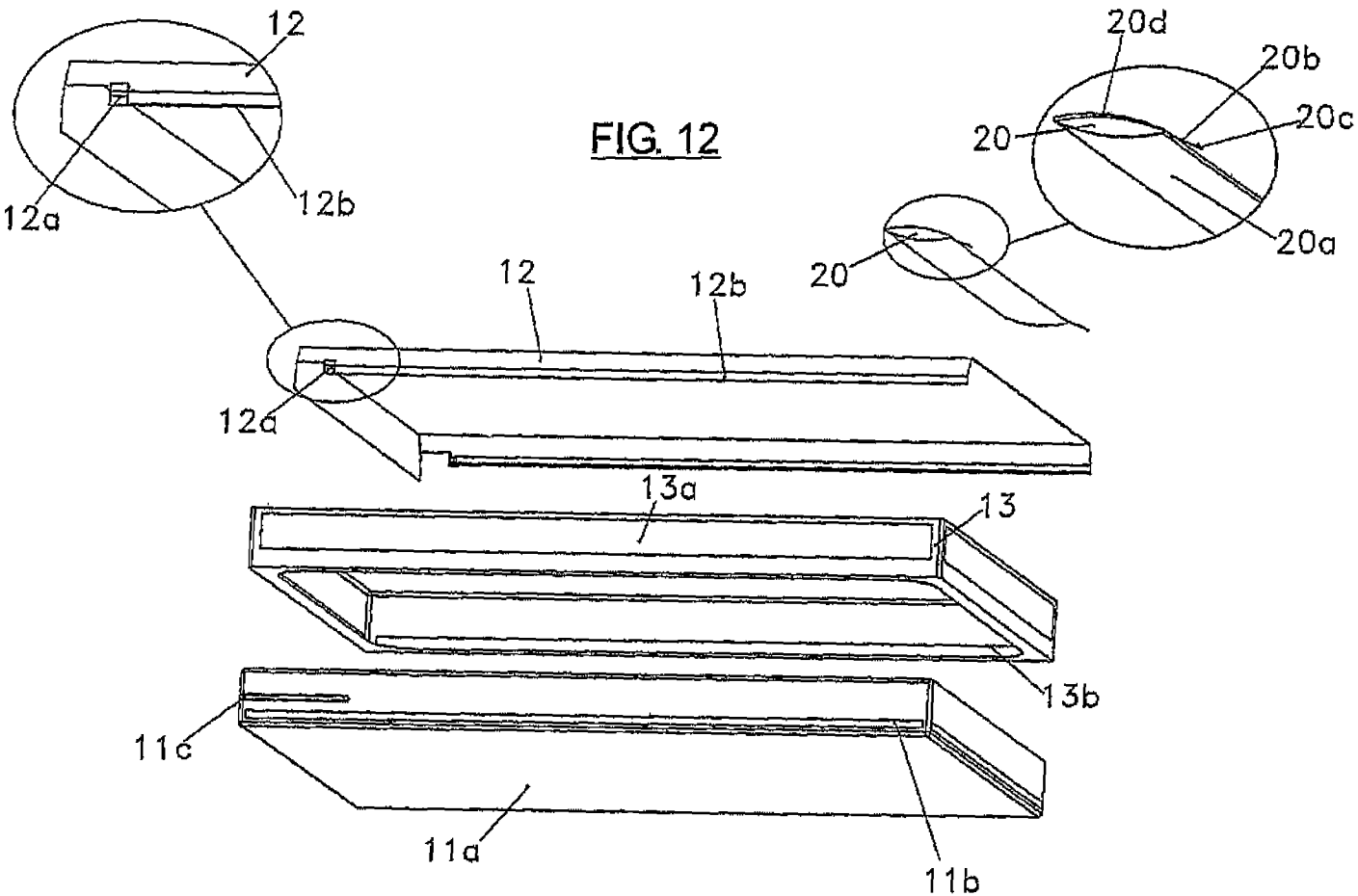
FIG. 12 is a perspective view showing the top bedcover (12) and in which the plastic guide (12*a*) and the cord (12*b*) going in its longitudinal edge can be seen, an enlarged detail of this

Another feature of the invention is that (FIGS. 7 to 11) at the head of the bed for each of the pillows (20) there is a frame (22) with a type of tray (21) which is made of a round tube (21), the ends of which are attached to the mobile unit (22*b*) and are capable of turning the tray (21) over therein between a vertical position placed against the rear part of the head of the bed and another horizontal position capable of holding the pillow (20) above the level of the top bedcover (12) when it is pressed from the bottom up by the tensor rod (7) in the active route of the moveable carriage (3); the trays (21) are linked, by means of a cable mechanism (24) and extension coil spring (25), to the mobile unit (22*b*); the tray (21) has relaxed and tensed states which correspond with said vertical and horizontal positions of the tray (21); a preferred embodiment is clearly shown in FIGS. 10 and 11 and consists of the mobile unit (22*b*) being guided in the frame of the head (22) and being provided with a lower flange (22*c*) and an upper hole (22*d*); in the raised position of the mobile unit (22*b*) the lower flange (22*c*) drives against a stop (21*a*) such that the non-driven and driven states correspond to respective vertical and horizontal positions of this tray (21); the upper hole (22*d*) is traversed by the tensing rope (23) which is attached at one end to the pillow cover (20*a*), and the plastic (20*c*) of the other end of the rope (23) in the housing (22*a*) which is in the upper part of the frame of the head (22). The function of turning over and straightening the pillows (20) is coordinated so that it takes place once the described process of straightening a top bedcover (12) has concluded which bed cover, according to the invention, may be a sheet, a duvet cover, a blanket, a comforter or any other type used, which would have on the two sides in the rear a plastic guide (12*a*) from which the lateral longitudinal cord (12*b*) emerges, going to the front end of the top bedcover (12) and arranged on a bottom sheet (13) provided with elastic and Velcro-type openable sticking means to attach it to the mattress cover (11*a*). This function is verified by means of a maneuver in which the pillow (20) or pillows (20) are repositioned, while at the same time the covers of the pillows (20*a*) are stretched and straightened, which function is carried out as follows: starting from the position indicated in FIG. 7, in which it is assumed that the bed has been used, the top bedcover (12) not yet being straightened (by the aforementioned mechanism) and the pillows (20) supported being out of place on the bed after having been used; upon activating the mechanism object of the invention, the mobile unit (22*b*) of each of the pillows (20) starts the upward movement such that when they reach the upper level of the bed, the lower flanges (22*c*) impact against the stops (21*a*) for turning over the trays (21) and the latter are introduced under these pillows (20) and start to raise them (FIG. 8), while at the same time, due to raising the mobile units (22*b*), the rope (23) is tensed, which rope, with one end fixed inside the housing (22*a*), is guided through the upper hole (22*d*), runs until the covers of said pillows (20*a*), whereby the latter are first repositioned in their correct place and then they are also stretched and straightened, being perfectly reusable, which is achieved when the end position of this maneuver (FIG. 9) is reached, in which the pillows (20) are raised above the level of the bed, waiting for the top bedcover (12) to be straightened, at which time the trays (21) begin the reverse maneuver, at which point there is a time in which, due to the inclination of the trays (21), the pillows (20) slide thereon and, from a small height, are deposited on the top bedcover (12) as shown in FIG. 7.

According to the invention, the operation of the electric geared motors consists of the frame (1) having a switch which, if it is placed in automatic mode when the user no longer occupies the bed, operates the electric geared motors and makes the bed, straightening and repositioning the bedclothes in an orderly fashion, and if the switch is placed in manual programmed mode, when the green button of the programming remote control is pressed or according to what is programmed, the electric geared motors which, in combination with sensors in the legs or in the lower part of the bed support, are capable of detecting the presence of a user supported on the bed, inhibiting the operation and activating the adjustable timer means which order the automatic operation after an established time in which said presence of a supported user has not been detected.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

The invention claimed is:

1. A mechanized bed for automatically straightening bedclothes, comprising:

A) a rectangular frame having a mattress and bedclothes said bedclothes having an inferior side, a head end, a foot end and two lateral ends with each end including a longitudinally extending cord at the edge of said lateral ends;

B) a bed support member having a base with a plurality of legs housed within said frame and said support member including two opposite facing sides;

C) two trapezoidal tracks (2) interiorly mounted respectively to said two opposite facing sides each track including an upper side with an upper face, an inclined upward side with an inclined upward face, an inclined downward side with an inclined downward face and a lower side with a lower face;

D) two moving carriages (3) mounted to said tracks (2), each carriage (3) having a mobile wheel (5) and a fixed wheel (4), said mobile wheel (5) cooperatively rolling against said upper, upward, downward and lower faces and said mobile wheel (4) rolling against said lower face so that said carriages (3) move reciprocally and horizontally from one extreme position to another, and said mobile wheels (5) moving around said tracks (2) along said upper face and downward face when said carriage moves towards one extreme position and along said lower face and upward face when moving in the opposite direction towards the other extreme position;

E) two tensor rods (7) mounted to said mobile wheels (5), respectively, and extending upwardly with respective distal ends (7*b*) that come in contact with said inferior side of said bedclothes and further including a stepped projection (7*a*) for each of said tensor rods defined at a predetermined distance from said distal ends (7*b*);

F) two spring biased rotating arm assemblies cooperatively mounted to said carriages (3), respectively, and coacting with said stepped projections (7*a*) said arm assemblies being biased against, and come in coact with, said rods (7) and allowed to rotate 90 degrees after clearing said stepped projection when said mobile wheel (5) is rolling against said lower face, and said arm assemblies further including each a longitudinally extending craddle for partially and slidably receiving said cord; and G) two pressure rollers (10) mounted to said rotating arm assemblies, respectively, each of said rollers (10) having an axis, said rollers being in the at rest position when said rollers' axes are in the vertical position and coacting against said cord when the axes are in the vertical position.

2. The mechanized bed for automatically straightening bedclothes according to claim 1, characterized in that each moveable carriage (3) is guided by a bar (14) mounted to said bed support member and extending at a parallel and spaced apart relationship with respect to said bed support member; and an endless cable (15) mounted to said carriage (3) and driven by an electric geared motor (16).

3. The mechanized bed for automatically straightening bedclothes according to claim 2, characterized in that moveable carriage (3) moves between two extreme positions from the foot end to the head end of the bed following an active route, a return route following the opposite path, a first transitional route for the transition from the return route to the active route and a second transitional route for the transition from the active route to the return route; in the active route mobile wheel (5) travels on the upper side of trapezoidal track (2) and tensor rod (7) is in its raised position, with its tip pressing the lower face of the top bedcover (12) from the bottom up, while at same time the pressure roller (10) is in its rotated position pressing said lower face of the top bedcover (12) in a location above a cord (12*b*) housed in a sliding manner in a horizontal wedge (8*a*) of the rotating arm (8); in the return route the mobile wheel (5) travels on the lower side of the trapezoidal track (2) and the tensor rod (7) is in its lowered or inhibited position, while at the same time the pressure roller (10) is with its axis in the horizontal position matching the rest position of the rotating arm (8) driven by an opposing circlip (9); in the first transitional route for the transition from the return route to the active route the mobile wheel (5) including biasing spring (6) travels on the upward side of the track and drives the tensor rod (7) to its raised position against the circlip (9) of the rotating arm (8); in the transitional route for the transition from the active route to the return route the mobile wheel (5) is guided between the downward side of the trapezoidal track (2) and a partition (17) parallel thereto, a rail being formed therebetween which has an outlet at its lower end traversed by a door (18) the closing of which is driven by an opposing spring (19).

4. The mechanized bed for automatically straightening bedclothes according to claim 3, characterized in that the trapezoidal track (2) in the rear part (feet) of the outer face has a housing (2*a*) in which there is housed the plastic guide (12*a*) having on a side in the rear part (feet) the top bedcover (12) so that when the rotating arm (8) rotates 90° it always positions the pressure roller (10) at the level of the plastic guide (12*a*) above and at the beginning of the cord (12*b*), the cord (12*b*) being housed in a sliding manner in the horizontal wedge (8*a*) of the rotating arm (8).

* * * * *